US007931754B2

(12) United States Patent
Kehl et al.

(10) Patent No.: US 7,931,754 B2
(45) Date of Patent: Apr. 26, 2011

(54) DISHWASHER WITH MIST CLEANING

(75) Inventors: Dennis L. Kehl, Benton Harbor, MI (US); Sathish Andrea Sundaram, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 247 days.

(21) Appl. No.: 12/265,781

(22) Filed: Nov. 6, 2008

(65) Prior Publication Data

US 2010/0108102 A1 May 6, 2010

(51) Int. Cl.
*B08B 3/02* (2006.01)

(52) U.S. Cl. ..... 134/25.1; 239/229; 134/198

(58) Field of Classification Search ..... 134/105, 134/102.1, 198; 239/229
See application file for complete search history.

(56) References Cited

U.S. PATENT DOCUMENTS

| | | | | | |
|---|---|---|---|---|---|
| 2,622,926 | A | * | 12/1952 | Oswald | 239/229 |
| 2,758,874 | A | * | 8/1956 | Snyder | 239/229 |
| 2,977,963 | A | | 4/1961 | Klint | |
| 3,009,648 | A | * | 11/1961 | Hait | 239/201 |
| 3,108,749 | A | * | 10/1963 | Drayer et al. | 239/102.1 |
| 3,214,819 | A | * | 11/1965 | Guerin | 264/119 |
| 4,135,531 | A | * | 1/1979 | Federighi et al. | 134/95.3 |
| 4,611,759 | A | * | 9/1986 | Cox | 239/229 |
| 5,017,852 | A | | 5/1991 | Nagata et al. | |
| 5,074,471 | A | * | 12/1991 | Baumgarten et al. | 239/284.1 |
| 5,241,975 | A | | 9/1993 | Yanagihara | |
| 5,248,095 | A | * | 9/1993 | Rankin et al. | 239/261 |
| 7,699,938 | B2 | * | 4/2010 | Fujii et al. | 134/31 |
| 2004/0250837 | A1 | | 12/2004 | Watson et al. | |
| 2009/0001196 | A1 | * | 1/2009 | Grez | 239/229 |

FOREIGN PATENT DOCUMENTS

JP 2007-075249 * 3/2007

* cited by examiner

*Primary Examiner* — Frankie L Stinson
(74) *Attorney, Agent, or Firm* — Robert A. Bacon; McGarry Bair PC

(57) ABSTRACT

A dishwasher having a liquid spraying system operable in a first mode to spray a focused stream of liquid within the wash chamber, and operable in a second mode to spray a diffused stream of liquid within the wash chamber.

19 Claims, 14 Drawing Sheets

DISHWASHER WITH MIST CLEANING

BACKGROUND OF THE INVENTION

1. Field of the Invention

This invention generally relates to a dishwasher having a liquid spraying system for spraying liquid onto utensils to accomplish cleaning.

2. Description of the Related Art

The majority of conventional dishwashers for cleaning utensils, such as silverware, dishes, plates, bowls, glassware, pots, and pans, utilize a liquid sprayer for spraying liquid onto the utensils to remove soils. The sprayer is coupled to a pump or similar means to supply pressurized liquid to the sprayer to produce spray for cleaning the utensils. A wash liquid can be water or water mixed with a detergent, a drying aid, a spot reducer, or any other similar product that facilitates excellent cleaning of the utensils.

The spraying apparatus is commonly a rotating spray arm having multiple nozzles and is driven by the torque produced by two outwardly-directed nozzles on the ends of the spray arm. The nozzles direct a focused stream of wash liquid known as a jet at the utensils to clean and rinse the utensils. As the spray arm rotates, the jets rotate with the arm. This type of spray system relies on moving focused streams of high pressure liquid for cleaning.

A disadvantage of this type of sprayer is that a lot of the cleaning performance relies on the jet impacting the utensil to remove the soils by force. Depending on how the utensils are arranged, it is not always possible for every portion of a utensil to be contacted by the jet. To maintain stable hydraulic operation of the jets, a substantial amount of water is used, which may lead to an undesirable low wash aid concentration during cleaning, which can reduce the cleaning ability of the dishwasher. This leads to another disadvantage in that wash aids, such as detergents, are not always evenly distributed on the dishes as the jets do not directly contact all portions of the utensils. The deflecting and splattering of the liquid off of the utensils can further distribute the wash aid, but this method is hit and miss and highly dependent on the relative positioning of the utensils. Thus, it cannot be relied upon. The jets also produce significant acoustic sound levels due to the forcefulness with which the liquid jets are propelled onto various surfaces in the dishwasher.

SUMMARY OF THE INVENTION

In one aspect, the invention is a dishwasher comprising a housing defining a wash chamber, and a liquid spraying system. The liquid spraying system is operable in a first mode to spray a focused stream of liquid within the wash chamber, and operable in a second mode to spray a diffused stream of liquid within the wash chamber.

In another aspect, the invention is a method of washing utensils in a dishwasher comprising a housing defining a wash chamber in which the utensils are received. The method comprises spraying a diffused stream of liquid within the wash chamber, and spraying a focused stream of liquid within the wash chamber.

DESCRIPTION OF AN EMBODIMENT OF THE INVENTION

Figure 1:
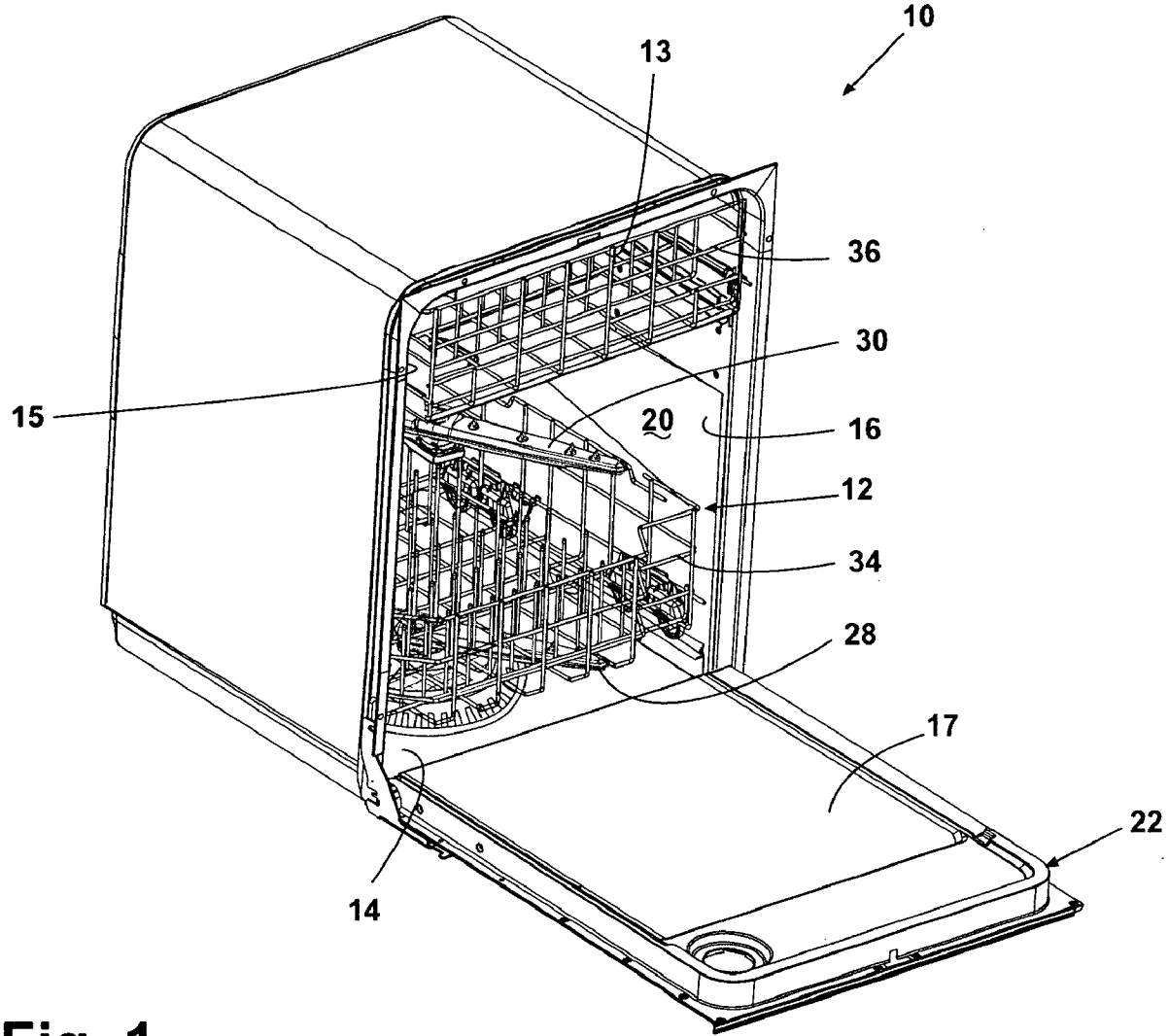
FIG. 1 is a perspective view of a dishwasher with a spraying system according to the invention.

Referring FIG. 1, an exemplary embodiment of a dishwasher according to the invention designated generally by the number 10. The dishwasher 10 comprises an interior housing 12 having a top wall 13, bottom wall 14, two side walls 15,16, a front wall 17, and a rear wall 18, all of which form an interior wash chamber 20 for washing utensils. As is well-known in the art, the front wall 17 can be the interior of a door 22, which can be pivotally attached to the dishwasher 10 for providing accessibility to the wash chamber 20 for loading and unloading utensils. While the present invention is described in terms of a conventional dishwashing unit, it could also be implemented in other types of dishwashing units, such as in-sink dishwashers or drawer-type dishwashers.

Figure 2:
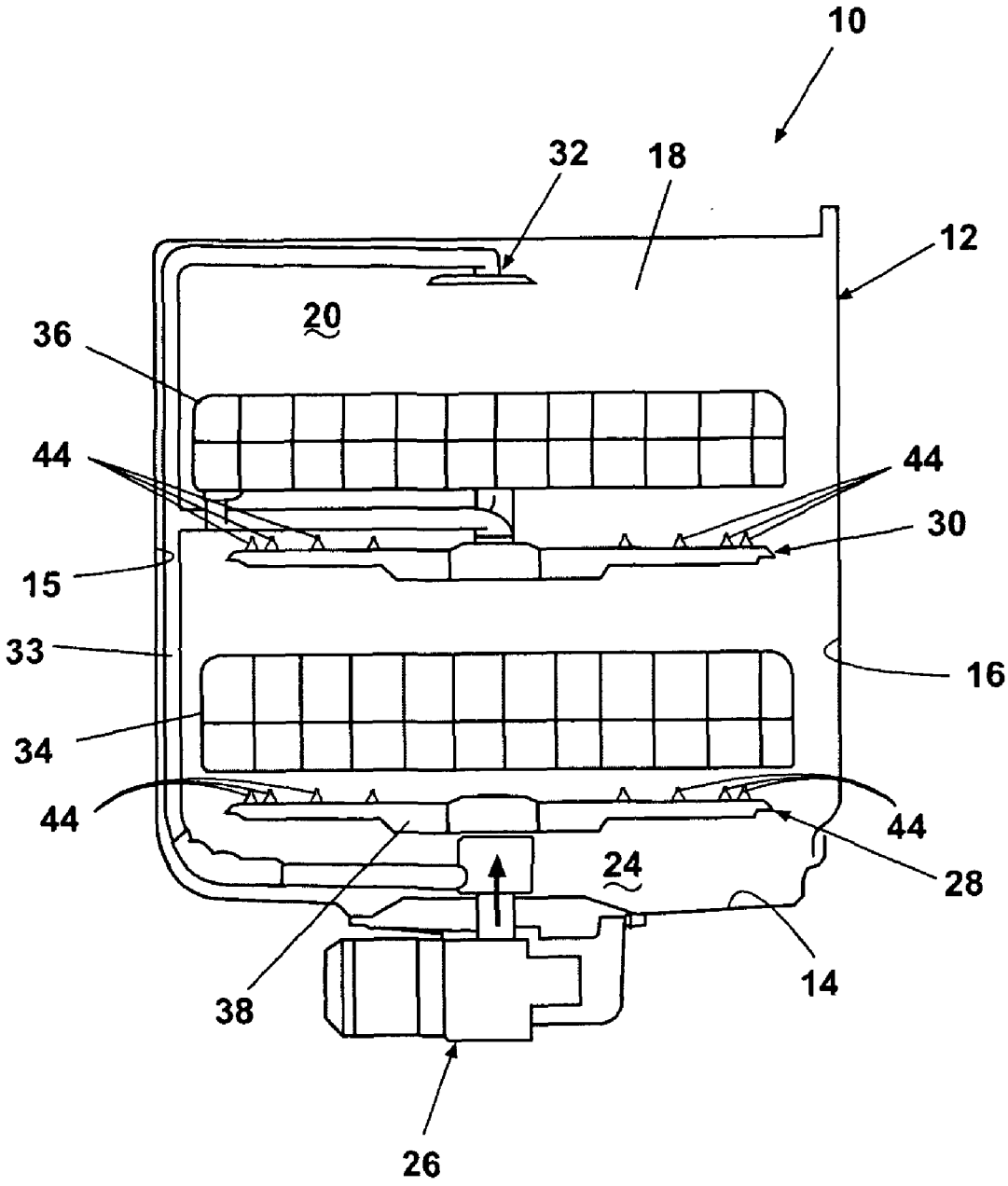
FIG. 2 is a front schematic view of the dishwasher of FIG. 1 illustrating the major components of the spraying system, including multiple spray arms.

Referring to FIG. 2, a wash liquid spraying system for use in the dishwasher 10 is used to spray liquid throughout the wash chamber to clean the dishes. The spraying system as illustrated comprises a pump assembly 26 that supplies liquid to bottom spray arm assembly 28, middle spray arm assembly 30, and top spray arm assembly 32, also referred to as sprayers 28, 30 and 32. Sprayers 28 and 30 are rotating arms and sprayer 32 is fixed. While illustrated with three sprayers, the spraying system can comprise more or less sprayers.

The pump is located within a sump portion 24 of the bottom wall. In this way, the pump 26 can draw wash liquid collecting in the sump and distribute it through the sprayers into the wash chamber, where it naturally flows back to the sump 24 for recirculation or draining as the case may be.

The pump assembly 26 is designed to pump wash liquid at varying pressures. One way of accomplishing the varying pressures is by operating the pump at different speeds. With such a configuration, it is possible to have either continuously varying pressures or multiple discrete pressures. For purposes of the invention, the pump should generate at least two distinct pressures, regardless of how they are accomplished.

A supply tube 33, extending from the pump, fluidly connects the pump to the sprayers 30 and 32. The supply tube 33 extends generally rearward from the pump assembly 21 to the rear wall 18 of the tub and extends upwardly to supply wash liquid to either of both of the middle spray arm assembly 30 and top spray arm assembly 32. The sprayer 28 is directly connected to the pump 26.

Control valves can control the flow of liquid from the pump to any of the sprayers 28, 30, and 32. The control valves can be selected such that liquid is concurrently or separately delivered to any combination of the sprayers 28, 30, and 32.

With continued reference to FIGS. 1 and 2, a lower dish rack 34 is positioned above the bottom spray arm assembly 28 and below the middle spray arm assembly 30. The upper dish rack 36 is positioned above the middle spray arm assembly 30 and below the top spray arm assembly 32. The lower dish rack 34 and upper dish rack 36 are designed to hold utensils of various shapes and sizes in a manner enabling liquid to contact and clean the utensils.

Figure 3:
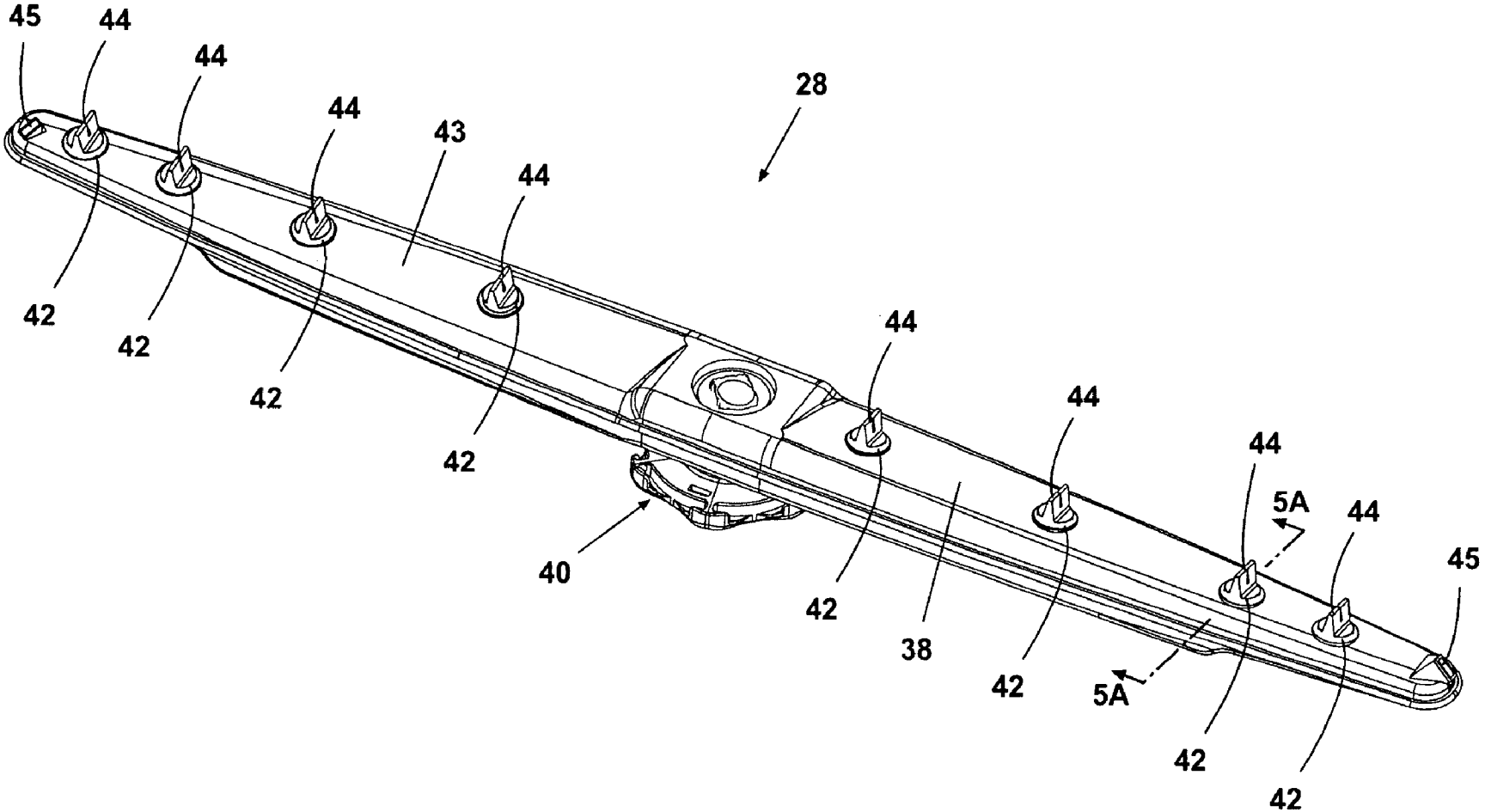
FIG. 3 is a perspective view of a spray arm of FIGS. 1 and 2 and comprising a plurality of nozzles.

Referring to FIG. 3, the bottom spray arm assembly 28 comprises a spray arm 38, a fluid coupler 40, a plurality of openings 42, and a plurality of nozzles 44. For the purposes of describing the invention, only the bottom spray arm assembly 28 will be described in detail. However, it will be understood that other arm assemblies 30, 32 present in the wash chamber 20 can also include any elements included in the bottom spray arm assembly 28.

Figure 5:
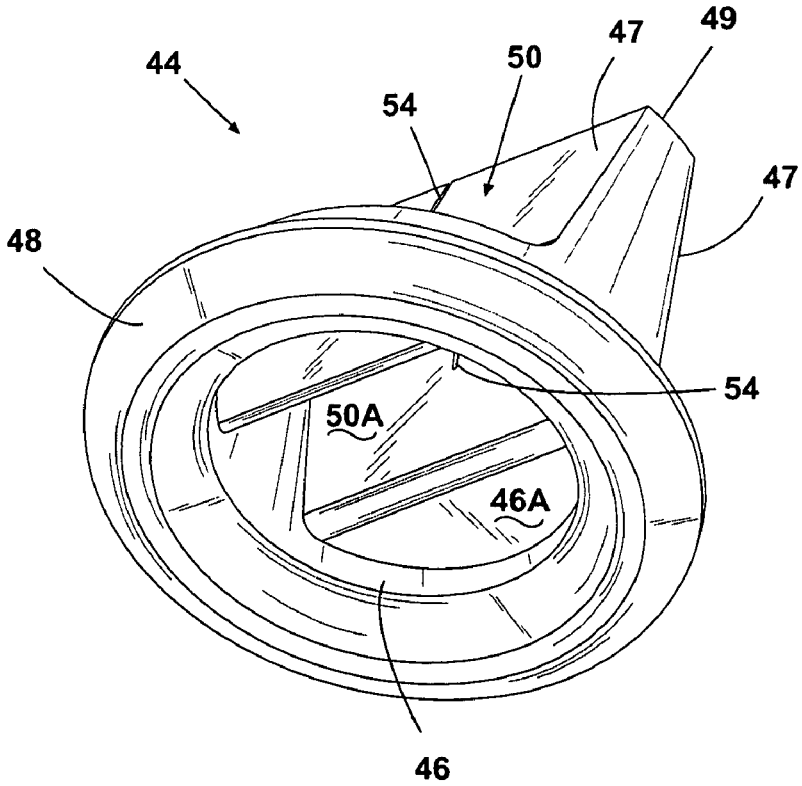
FIG. 5 is a perspective bottom view of the nozzle of FIG. 4.
Figure 5A:
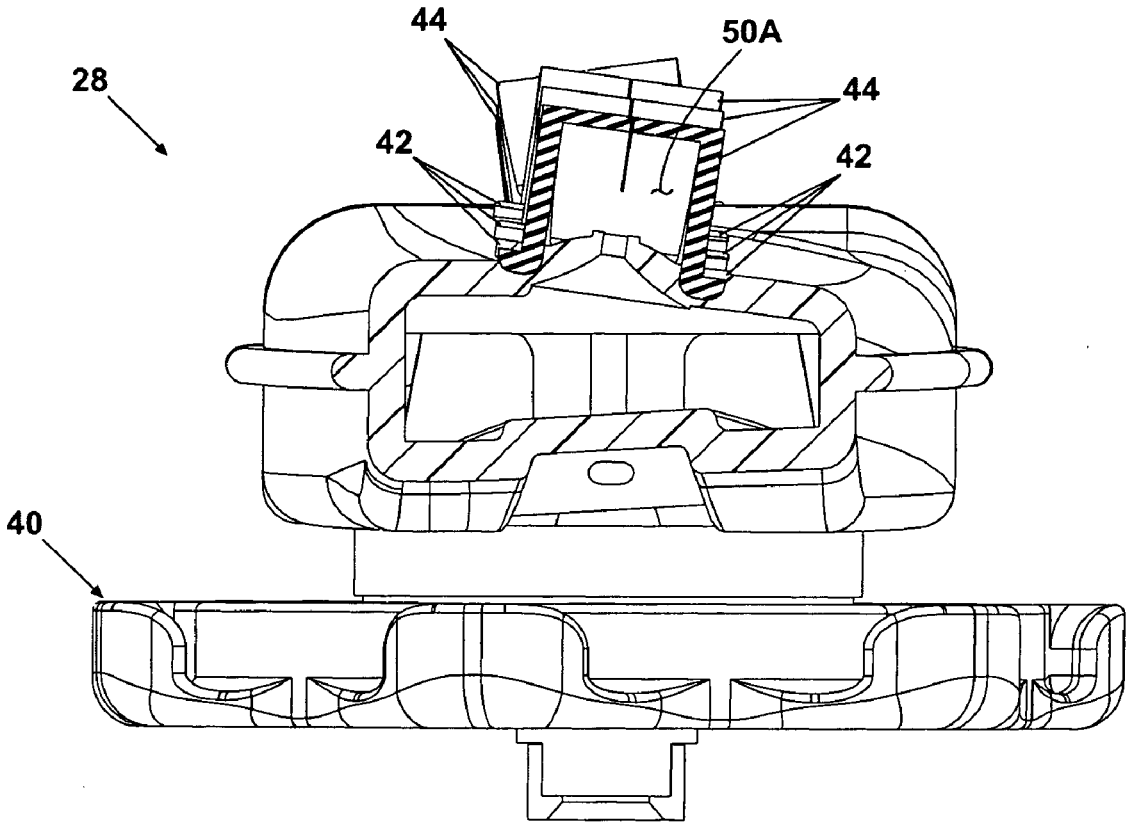
FIG. 5A is sectional view taken along the line 5A-5A of FIG. 3.

The spray arm 38 is an elongated, hollow member defining an interior chamber 39 (FIG. 5A). The interior chamber receives wash liquid from the pump assembly 26. The spray arm 38 is preferably formed integrally. Alternatively, the spray arm 38 comprise two separately-formed halves that can be welded together or attached by means of a snap fit. The fluid coupler 40 is located at the center of the spray arm 38. The fluid coupler 40 rotatably and fluidly couples the spray arm 38 to the pump assembly 26 so that the spray arm 38 can rotate and spray utensils located in the wash chamber 20.

A plurality of openings 42 is disposed about the spray arm 38. The openings extend from an outer surface 43 of the spray arm 38 into the interior chamber and are designed to permit the flow of wash liquid there through. The openings 42 can vary in size and shape so as to modify the flow of wash liquid. Located on each end of the spray arm 38 is a drive opening 45 oriented such that the flow of wash liquid out of the opening 42 will effect the rotation of the spray arm 38.

A nozzle 44 is disposed within the openings 42. The number of nozzles is not critical to the invention, more or less being acceptable. The nozzles 44 fit snugly into the openings 42 so as to create a fluid seal around the nozzle 44 while permitting liquid from the interior of the arm to pass through.

Figure 4:
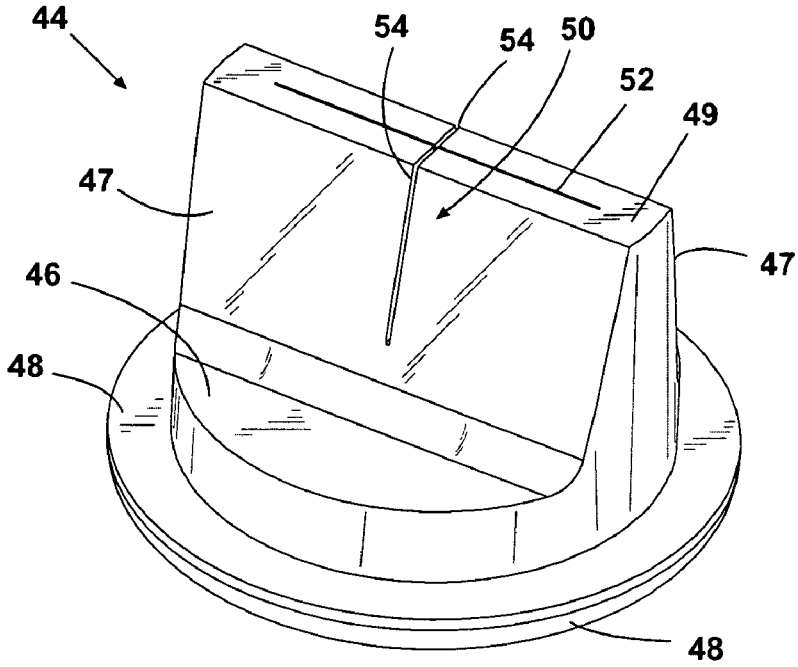
FIG. 4 is a perspective view of one of the nozzles from FIG. 3 and having a tip with both a horizontal and a vertical slit.

Referring to FIGS. 4-5A, the nozzle 44 comprises a base 46 and a tip 50. The base 46 comprises an annular body terminating at a first lower end in a flange 48 and defining an opening 46A through which liquid flows. The tip 50 extends from the base 46 and comprises opposing sloped sides 47 extending upwards from the base 46 and towards each other to a generally flat top edge 49. The sloped sides 47 create a triangular cross section such that the tip 50 tapers as it extends upwards from the base 46. The tip 50 also defines an interior 50A that communicates with the opening 46A in the base 46.

The nozzle 44 is preferably formed integrally of a relatively flexible material, as by molding. An exemplary material would be silicone rubber.

The tip 50 includes an horizontal slit 52 and two vertical slits 54 extending from the outside of the nozzle 44 into the interior 50A (FIG. 6) to form an outlet. The horizontal slit 52 is located on the top edge 49 of the tip 50. The vertical slits 52 extend through the sides into the interior of the nozzle and from the horizontal slit partially down the sides. The vertical slits 54 are centered along the width of the sloped sides 47. Both the horizontal and vertical slits 52, 54, extend from the outer surface of the tip 50 into the interior 50A.

Figure 6:
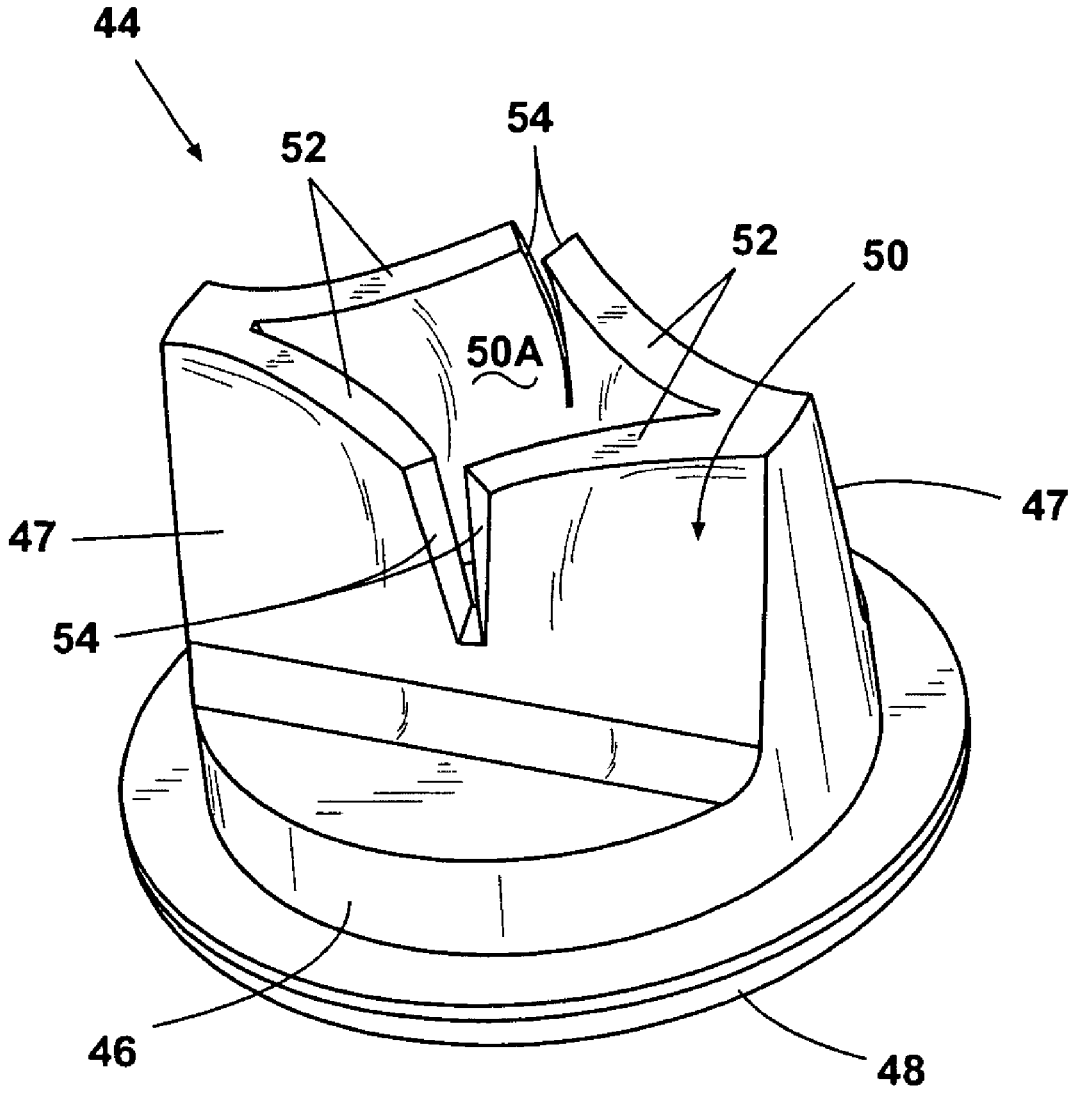
FIG. 6 is a perspective view of the nozzle of FIG. 4 as it would appear when producing a focused spray in the form of a jet.
Figure 7:
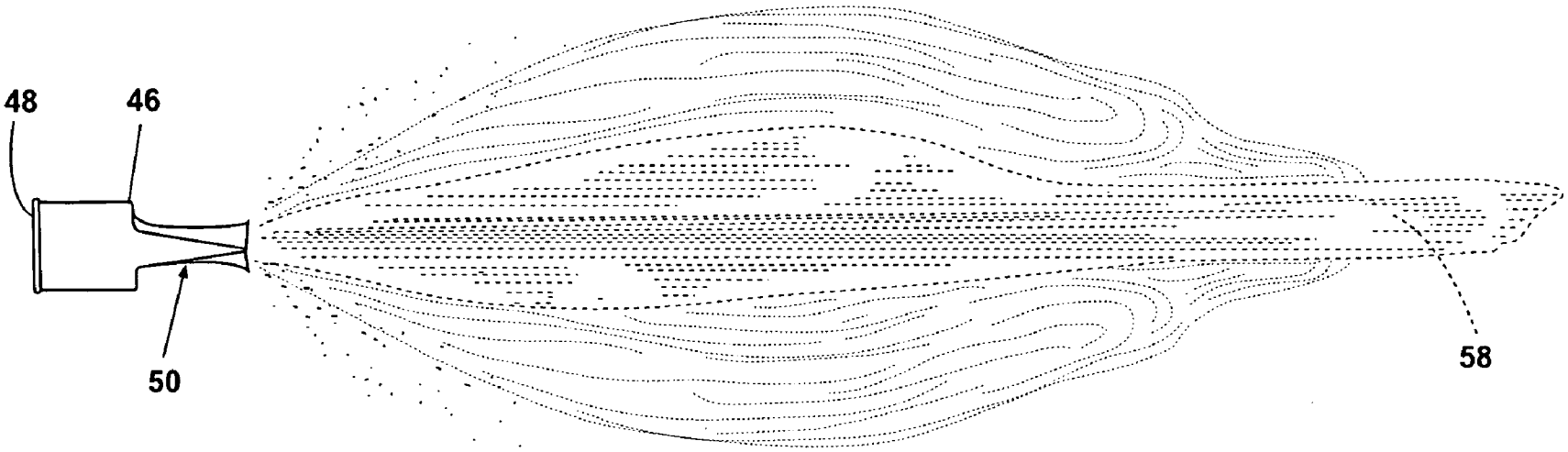
FIG. 7 is a top perspective view of the nozzle of FIG. 4 producing a focused spray in the form of a jet.
Figure 8:
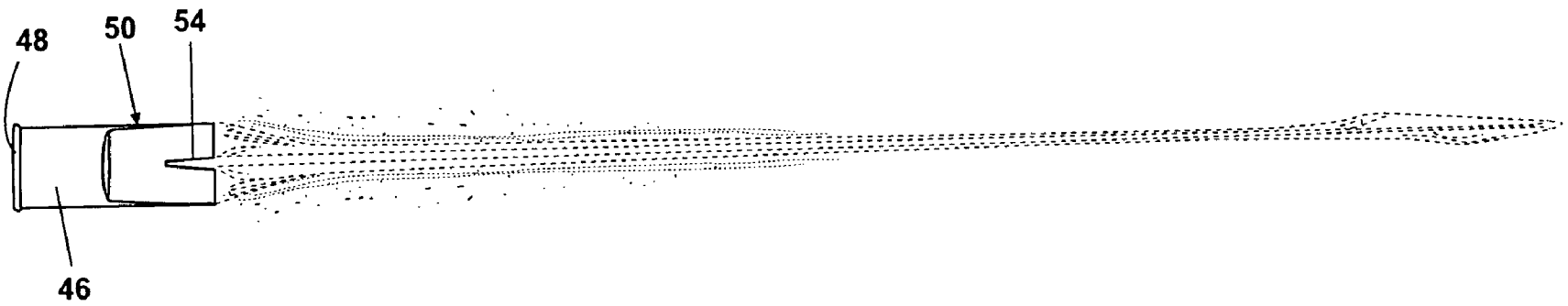
FIG. 8 is a side perspective view of the nozzle of FIG. 4 producing a focused spray in the form of a jet.
Figure 9:
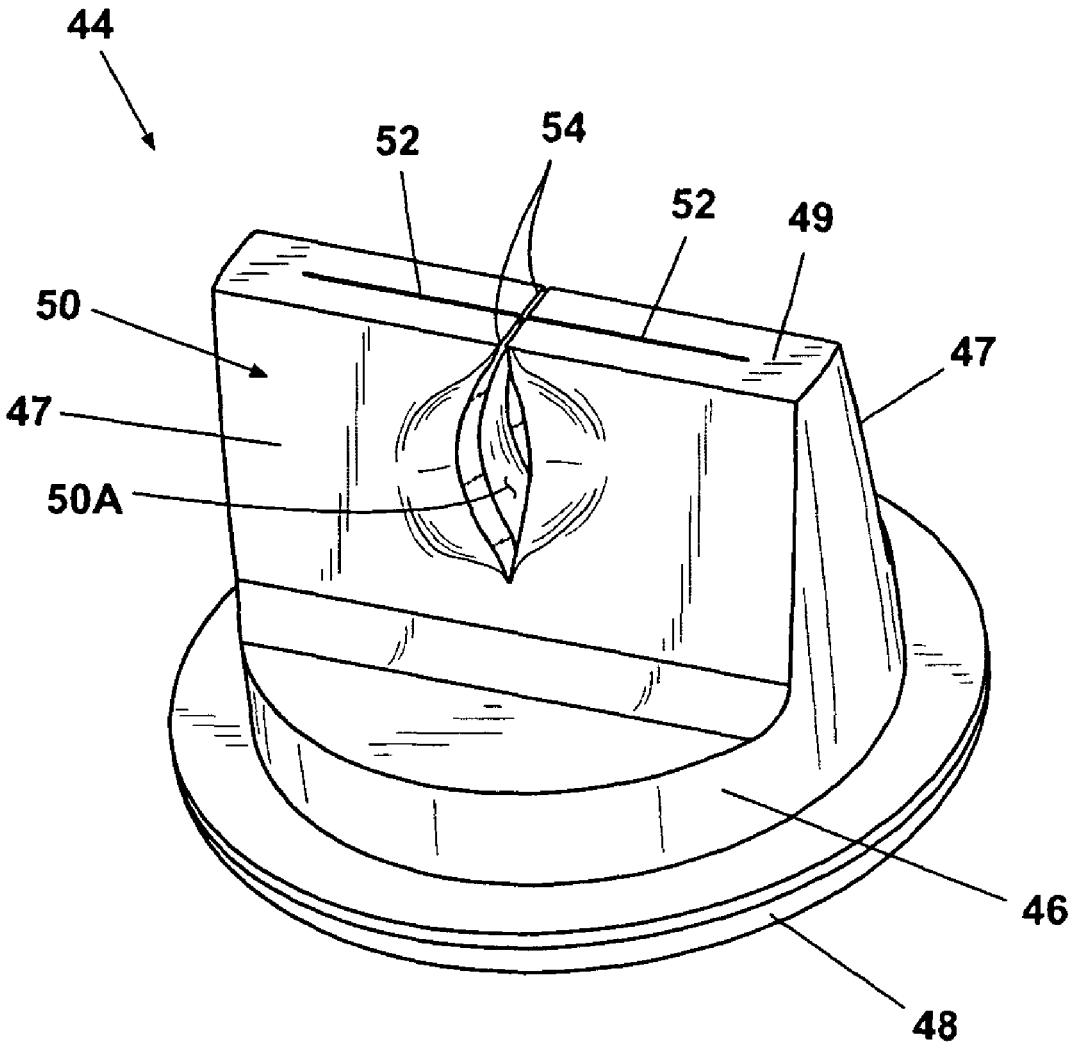
FIG. 9 is a perspective view of the nozzle of FIG. 4 as it would appear when producing a diffused spray in the form of a mist.
Figure 10:
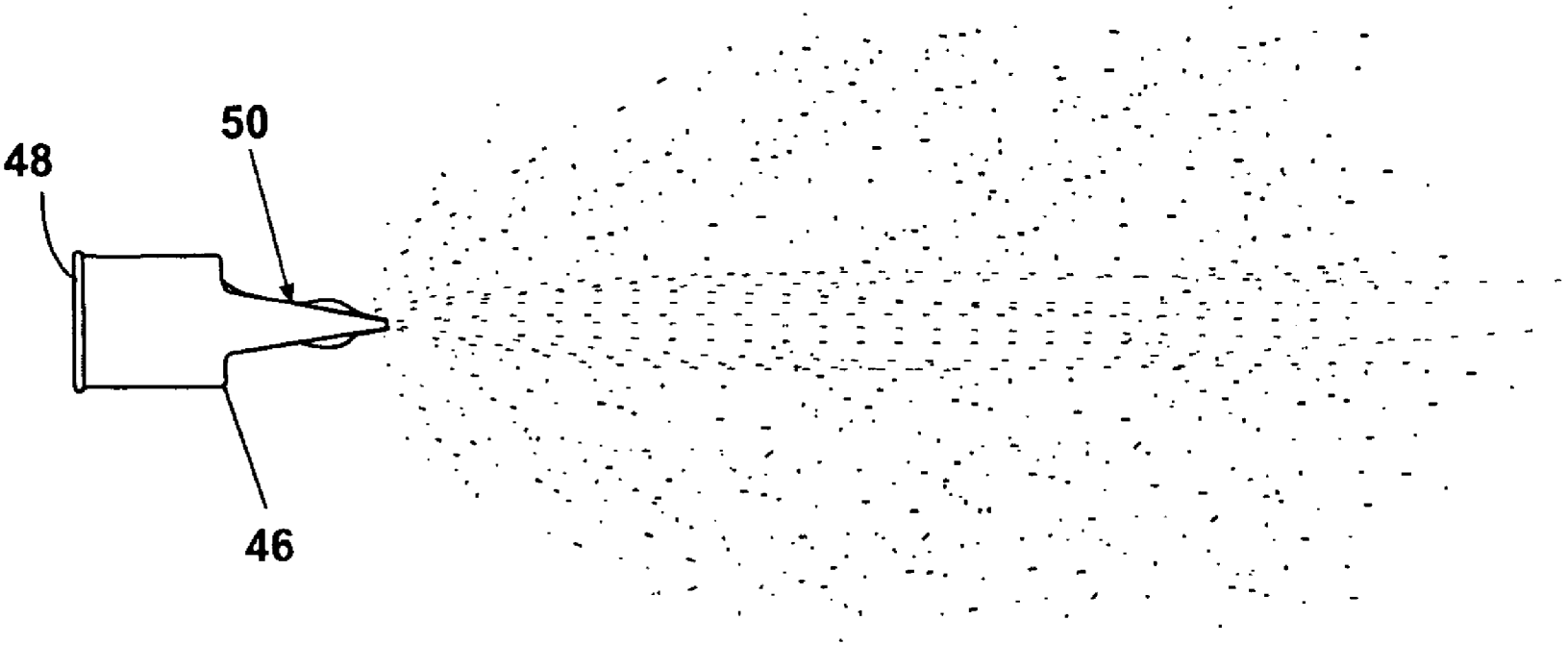
FIG. 10 is a top perspective view of the nozzle of FIG. 4 producing a diffused spray in the form of a mist.
Figure 11:
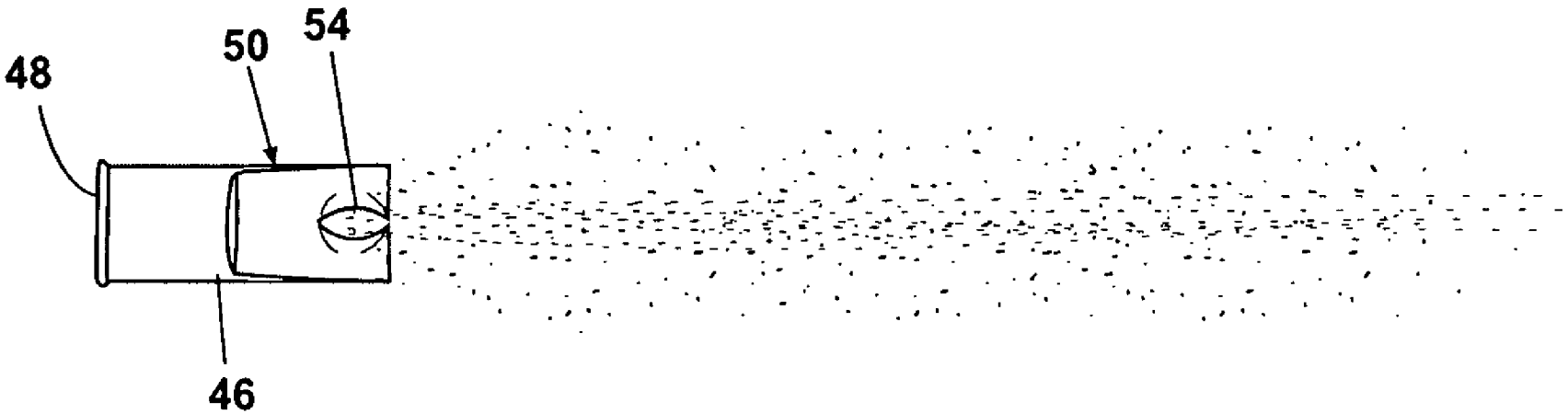
FIG. 11 is a side perspective view of the nozzle of FIG. 4 producing a diffused spray in the form of a mist.

The nozzles 44 in the spray arm 38 of the bottom spray arm assembly 28 can provide at least two distinct spray patterns or modes, which can be controlled by the pressure of the supplied liquid. A first spray mode comprises primarily a focused stream 58, which can be continuous, and is illustrated in FIGS. 6-8. A second spray mode is a diffused stream comprising spaced droplets of liquid with a more focused stream towards the center, and is illustrated in FIGS. 9-11. In the first mode, the pump assembly 26 pumps wash liquid at a higher pressure, which causes the nozzle 44 to assume the shape in FIG. 6 that produces a focused stream 58 of wash liquid shown in FIGS. 7 and 8. In the second mode, the pump assembly 26 pumps wash liquid at a lower pressure, which causes the nozzle 44 to assume the shape in FIG. 9 to produce a diffused stream of wash liquid shown in FIGS. 10 and 11.

As is typical in a conventional dishwasher, the bottom spray arm assembly 28 is configured to rotate in the wash chamber 20 and spray a flow of wash liquid in a generally upward direction. The spray from the bottom spray arm assembly 28 is typically directed to providing a wash for utensils located in the lower dish rack 34. Like the bottom spray arm assembly 28, the middle spray arm assembly 30 can also be configured to rotate in the dishwasher 10 and spray a flow of wash liquid in a generally upward direction. In this case, the spray from the middle spray arm assembly 30 is directed to utensils in the upper dish rack 36. Typically, the top spray arm assembly 32 directs a spray of wash liquid in a generally downward direction and helps clean utensils on both the lower and upper dish racks 34, 36.

The flexible nature of the nozzles 44 aids in the nozzle 44 assuming different shapes in response to the different liquid pressures. An appropriate high pressure and an appropriate low pressure to produce the focused stream 58 and dispersed stream respectively can be determined by testing, as the specific dimensions and materials used for each nozzle 44 will affect the water pressure required to produce each stream type. It should be noted that the adjectives high and low are used in describing the relative difference between the pressures and is not necessarily a description of the absolute pressure because in the environment of a contemporary dishwasher, both the high and low pressures are generally low pressures in an absolute sense.

To use the nozzle 44 in the first mode, wash liquid is propelled through the liquid spraying system at a higher pressure, and a jet of wash liquid is produced by the nozzle 44. A "jet" of liquid as used in this application is a focused stream 58 of wash liquid that contacts utensils with significant force for removing food remnants. The liquid spray associated with the jet may comprise a focused stream 58 with some associated diffused liquid particles, but the primary character of the liquid spray is that of a focused stream 58. The pressure is great enough that it causes both the horizontal and vertical slits to "crack" open as illustrated in FIG. 6. The resulting opening is relatively large and unobstructed, permitting the liquid to flow through relatively un-impeded FIGS. 7 and 8 illustrate the resulting jet of wash liquid as a central jet surrounded by associated diffused droplets. The majority of wash liquid is projected in a straight direction and upward from the nozzle 44. Nozzles 44 incorporating vertical slits 54 produce a gradually widening jet with the flow focused towards the middle.

To use the nozzle 44 in the second mode, wash liquid is propelled through the liquid spraying system at a lower pressure, and a diffused stream of wash liquid is produced by the nozzle 44. A "diffused stream" as used in this application is a dispersed stream of wash liquid. A mist is one example of a diffused stream wherein wash liquid particles are of a size rendering them buoyant in the air within the wash chamber 20. Typically, these wash liquid particles are less than 100 microns in size. The second mode also requires significantly less water to maintain stable hydraulic operation. The lower pressure is great enough to crack the vertical slits, but not great enough to crack the horizontal slit, which results in the nozzle 44 taking on the shape as shown in FIG. 9. At the lower pressure, the horizontal slit 54 opens slightly, if at all. Due to the restricted flow path, the vertical slit 54 experiences greater pressure, and the surrounding portion of the nozzle 44 bulges outward. Looking now at FIGS. 10 and 11, the resulting mist of wash liquid is a dispersed stream projected outward from the nozzle 44.

One method of utilizing the dual-mode nozzles 44 in the dishwasher 10, is to use the second mode for the distribution of a liquid, such as a detergent solution, on the utensils loaded in the dishwasher 10 to effect a soaking of the soils on the utensils with a detergent solution, and then hit the soaked soils with a focused stream 58 using the second mode. The detergent solution chemically breaks down the soils and the focused stream 58 mechanically removes the soils.

More specifically, as the wash liquid used at the beginning of the wash cycle comprises a detergent wash aid mixed with water, using a diffused stream, such as a mist, more widely distributes the detergent solution than what is obtainable with the traditional focused stream. Advantageously, the greater distribution is accomplished with less liquid than the focused stream. In many cases, the distribution is at a higher concentration because less liquid is used. This wider distribution of a higher concentration of detergent solution improves the removal of the soils from the utensils because more chemistry gets to more of the utensils. The dispensed detergent solution can be permitted to sit and soak into the soils. The minimized amount of water stored in the dishwasher 10 also significantly reduces the overall water requirements, and consequently, the electric energy required for heating the water. Additionally, since the wash liquid particles of the mist are buoyant within the air, the wash liquid is distributed more evenly throughout the wash chamber 20. This further improves the performance of the dishwasher 10, as all utensils in the dishwasher 10 are contacted by sufficient amounts of wash liquid for effective cleaning. The noise produced by the dishwasher is also lessened due to the reduced operating pressure.

Once the detergent has been dispersed throughout the wash chamber 20, and after any soaking period, the dishwasher 10 cleans the utensils using the first cleaning mode. The jets contact the utensils with significant force, which serves to mechanically remove the soils that have been chemically loosened or broken down.

The flexibility of the nozzles serves another purpose, one that is particularly noticeable at this stage during which many food particles are present throughout the dishwasher: the nozzles are self-cleaning. Unlike the rigid nozzles found in conventional dishwashers, any food or debris that enters the nozzle 44 will not become stuck, as the nozzle 44 changes shape each time it is used. Food and debris is therefore inherently removed from the nozzle 44 simply by operating the dishwasher 10.

After the cleaning stage, the dishwasher 10 is again operated in the second mode. The detergent is rinsed off of the utensils using a wash liquid comprising water and, optionally, a drying aid. Using the mist spray for drying purposes is beneficial as it requires less water consumption. Additionally, it has been shown that using a mist spray at this stage produces better drying characteristics. The utensils dry faster because the wash liquid particles are smaller; therefore, the particles require less energy to evaporate compared to larger water droplets associated with a jet spray. The mist spray also produces better wash liquid coverage throughout the dishwasher, further improving drying characteristics by more evenly distributing the drying aid.

Figure 12:
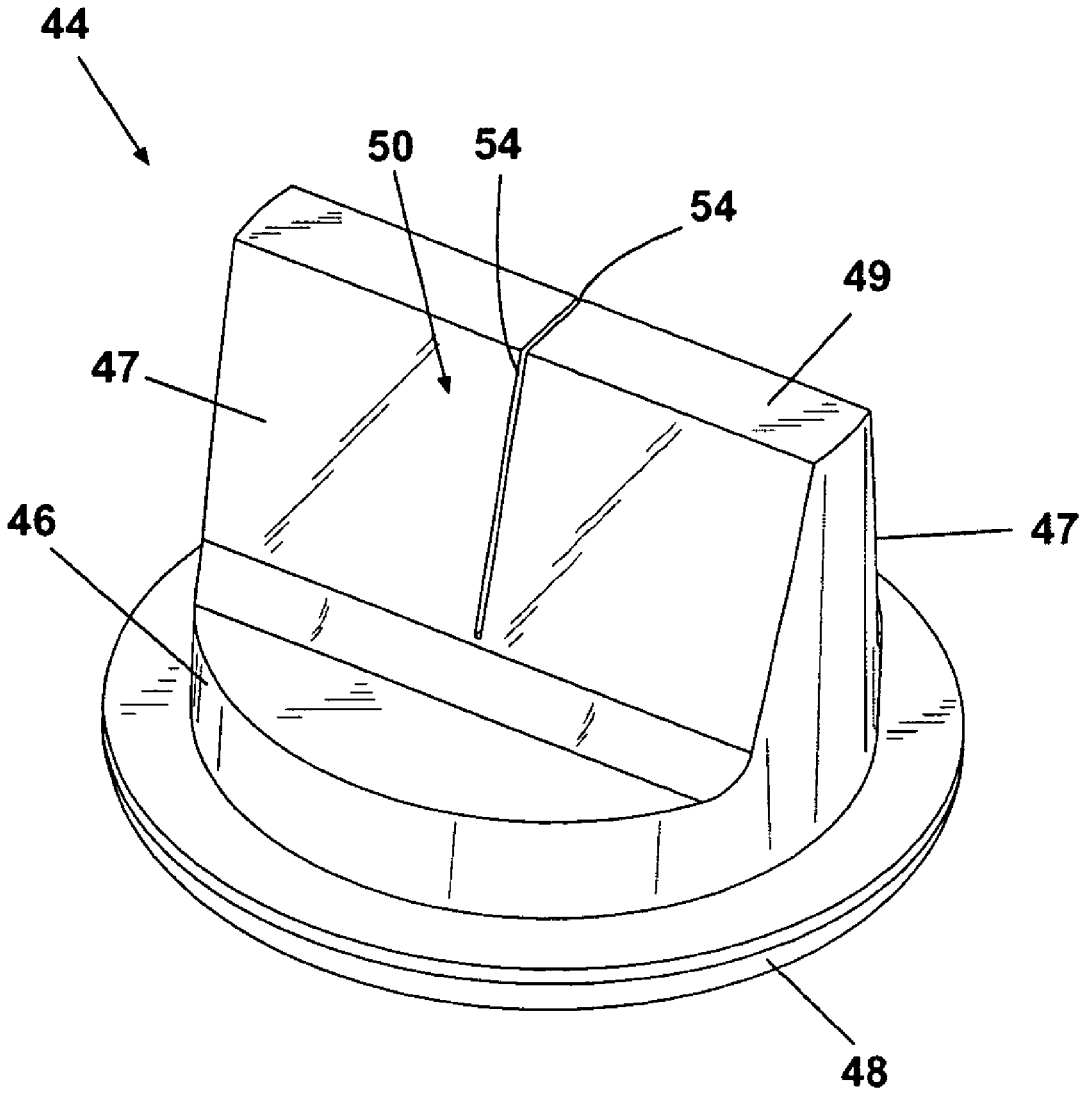
FIG. 12 is a perspective view of a first alternative embodiment of the nozzle according to the invention and having only a vertical slit.

FIG. 12 illustrates a first alternative embodiment having substantially the same construction as the exemplary embodiment of the nozzle 44 sans the horizontal slit 52.

Figure 13:
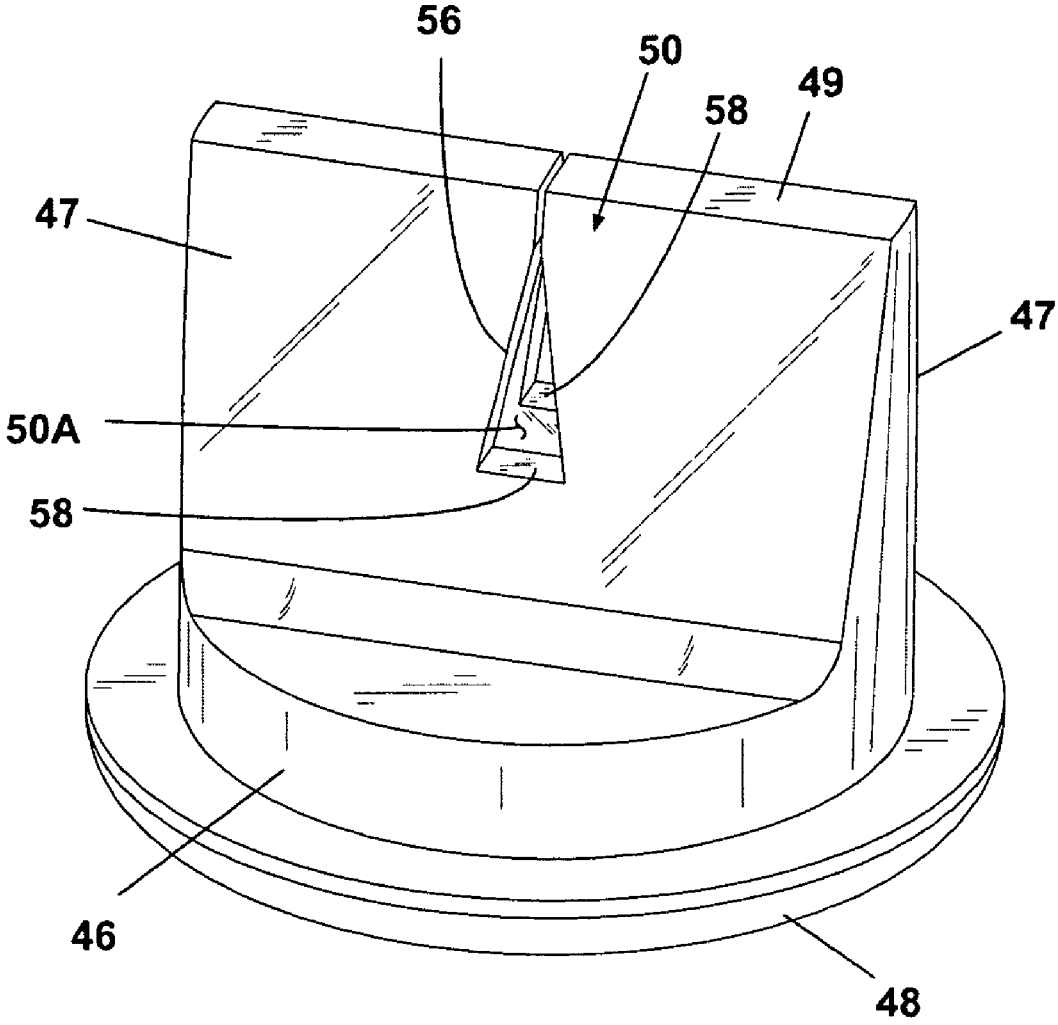
FIG. 13 is a perspective view of a second alternative embodiment of the nozzle according to the invention and having an angled vertical slit.

FIG. 13 shows a second alternative embodiment also having substantially the same construction as the exemplary embodiment but with vertical notches 56 instead of vertical slits 54. The vertical notches 56 extend upward from a point above the bottommost portion of the tip 50 to the top edge 49 where they intersect. The vertical notches 54 are centered along the width of the sloped sides 47. The vertical notches 54 have the general shape of an isosceles triangle and are oriented such that the bases 58 of the notches 54 are nearest and parallel to topmost surface of the base 46.

Figure 14:
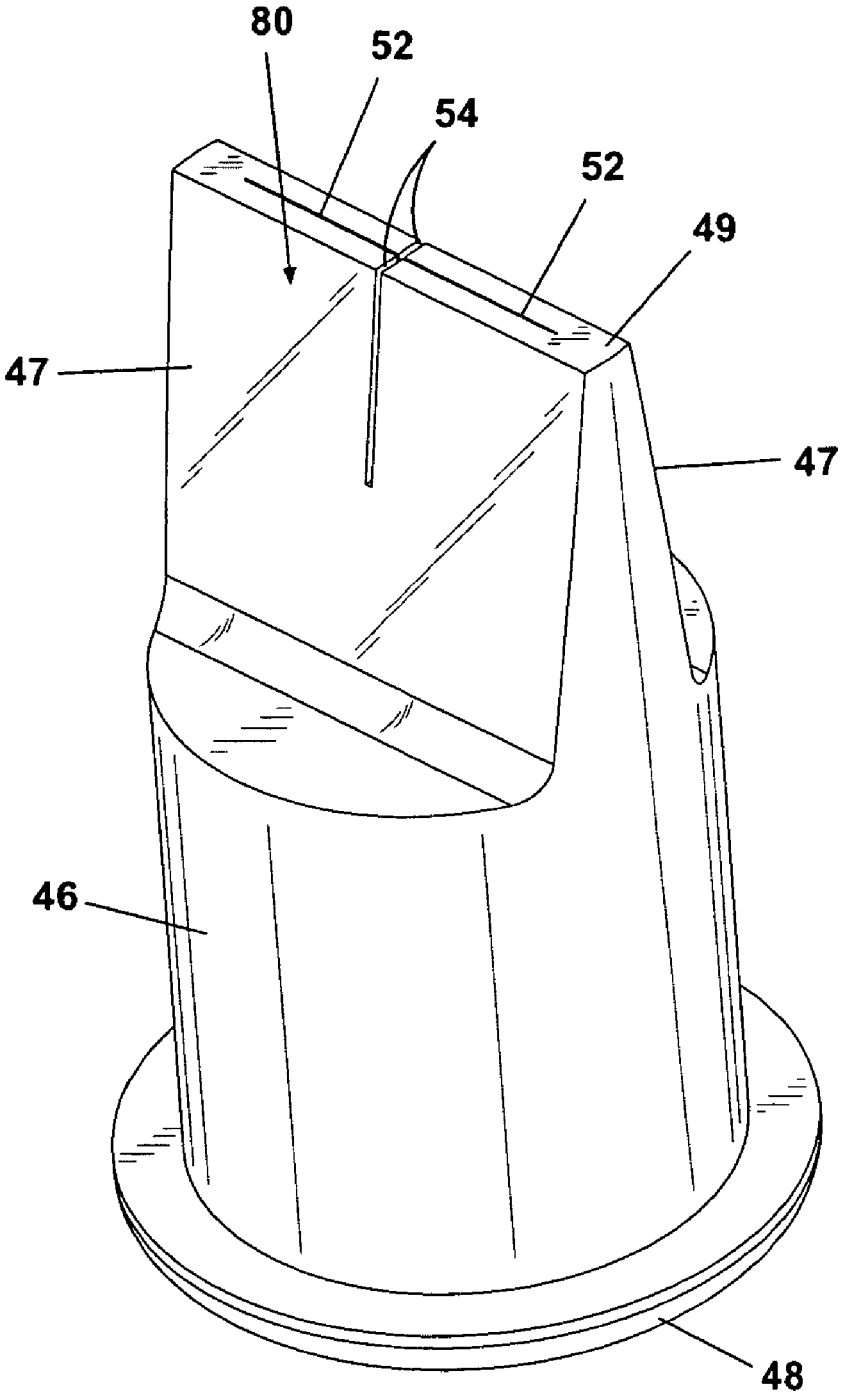
FIG. 14 is a perspective view of a third alternative embodiment of the invention and having both vertical and horizontal slits and an extended base.

FIG. 14 illustrates a third alternative embodiment having substantially that same construction as the exemplary embodiment of the nozzle 44 but with a vertically extended base 46.

The dishwasher 10 and method of washing utensils according to the invention enable superior cleaning of utensils. This is accomplished through the inclusion of flexible nozzles 44 in at least one spray arm 38, which, in combination with the variable speed pump assembly 26, are capable of producing both a focused stream of wash liquid and a dispersed stream of wash liquid. Alternatively, the spray arm 38 could incorporate a combination of traditional nozzles and the nozzles of the invention 44 to produce different spray types at the same time. Similarly, separate spray arm assemblies within the wash chamber 20 could use different types of nozzles to accomplish the same. Separate arm assemblies having different types of nozzles could also be connected to different pump assemblies or different supply tubes to create different spray types at different times, or at the same time. By using the nozzles of the invention 44 along with the variable speed pump 26, not only are food soils and debris removed much more effectively, but resource consumption is reduced as well. Less water is used to clean the utensils, and, accordingly, less electricity is required to heat and pump the water.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a housing defining a wash chamber;

a liquid spraying system comprising at least one shape-changing nozzle having a first shape, where the nozzle generates a focused stream, and a second shape, where the nozzle generates a diffused stream; and wherein the nozzle changes shape based on the pressure of the liquid supplied to the nozzle, such that the liquid spray system is operable in a first mode to spray a focused stream of liquid within the wash chamber, and operable in a second mode to spray a diffused stream of liquid within the wash chamber.

2. The dishwasher according to claim 1, wherein the diffused stream of liquid comprises a mist.

3. The dishwasher according to claim 2, wherein the mist comprises particles that are buoyant within air.

4. The dishwasher according to claim 3, wherein the particles are less than 100 microns.

5. The dishwasher according to claim 2, wherein the focused stream of liquid comprises a jet of liquid.

6. The dishwasher according to claim 1, wherein the first mode actuates at a higher liquid pressure than the second mode.

7. The dishwasher according to claim 1, wherein the liquid spraying system comprises a sprayer having at least one of the shape-changing nozzles.

8. The dishwasher according to claim 7, wherein the liquid spraying system comprises a pump for supplying liquid to the sprayer.

9. The dishwasher according to claim 8, wherein the pump is operable at a first liquid pressure and a second liquid pressure, which is less than the first liquid pressure, wherein the sprayer generates the focused stream when supplied liquid at the first pressure, and the sprayer generates the diffused stream when supplied liquid at the second pressure.

10. The dishwasher according to claim 1, wherein the sprayer is a rotating spray arm.

11. The dishwasher according to claim 1, wherein the nozzle has a duck bill shape terminating in a tip, with at least one of a vertical slit and a horizontal slit formed in the tip.

12. The dishwasher according to claim 11, wherein both of the vertical slit and horizontal slit are formed in the tip.

13. A method of washing utensils in a dishwasher comprising a housing defining a wash chamber in which the utensils are received, the method comprising:

supplying liquid at a first pressure to a shape-changing nozzle having at least two configurations depending on the pressure of the supplied liquid to form a focused stream of liquid within the wash chamber;

supplying liquid at a second pressure, different from the first pressure, to the shape-changing nozzle to form a diffused stream of liquid within the wash chamber;

wherein the dishwasher is operable in different spray modes depending on the pressure of the supplied liquid.

14. The method according to claim 13, wherein the spraying a diffused stream comprises spraying a diffused stream of wash liquid containing a wash aid.

15. The method according to claim 13, wherein the spraying of the diffused stream of liquid comprises spraying a mist.

16. The method according to claim 15, wherein the mist comprises particles that are buoyant within air.

17. The method according to claim 16, wherein the particles are less than 100 microns.

18. The method according to claim 13, wherein the spraying of the focused stream of liquid comprises spraying a jet of liquid.

19. The method according to claim 13, wherein the spraying of the diffused stream of liquid occurs at a lower liquid pressure than the spraying of the focused stream.

* * * * *